United States Patent [19]

Schulze et al.

[11] Patent Number: 4,810,116

[45] Date of Patent: Mar. 7, 1989

[54] RIBBON CASSETTE

[75] Inventors: Jürgen Schulze, Nuremberg; Rettkel Wilfried, Altdorf, both of Fed. Rep. of Germany

[73] Assignee: Ta-Triumph-Adler Aktiengesellschaft, Nuremberg, Fed. Rep. of Germany

[21] Appl. No.: 49,960

[22] Filed: May 15, 1987

[30] Foreign Application Priority Data

May 23, 1986 [DE] Fed. Rep. of Germany ..... 3617387

[51] Int. Cl.[4] ..... B41J 32/00

[52] U.S. Cl. ..... 400/208; 400/249

[58] Field of Search ..... 400/194–196 H, 400/208, 249

[56] References Cited

U.S. PATENT DOCUMENTS

| | | | |
|---|---|---|---|
| 4,406,554 | 9/1983 | Dreinhoff | 400/249 |
| 4,491,430 | 1/1985 | Kuelzer | 400/249 X |
| 4,494,886 | 1/1985 | Kondo | 400/249 X |
| 4,586,837 | 5/1986 | Johnson | 400/249 X |

FOREIGN PATENT DOCUMENTS

| | | | |
|---|---|---|---|
| 2646603 | 4/1978 | Fed. Rep. of Germany | 400/249 |
| 7910078 | 7/1979 | Fed. Rep. of Germany | 400/249 |
| 3109299 | 1/1982 | Fed. Rep. of Germany | 400/249 |
| 74181 | 5/1982 | Japan | 400/249 |
| 78879 | 5/1984 | Japan | 400/249 |
| 107380 | 6/1985 | Japan | 400/708 |
| 212376 | 10/1985 | Japan | 400/249 |

OTHER PUBLICATIONS

*IBM Tech. Disc. Bulletin*, by W. M. Jenkins, vol. 27, No. 6, Nov. 1984, pp. 3645–3647.

*Primary Examiner*—Paul T. Sewell

*Attorney, Agent, or Firm*—Browdy and Neimark

[57] ABSTRACT

A ribbon cassette for electronically controlled typewriters or similar machines equipped with a signal generator, the ribbon cassette being disposed on a carriage moveable along the platen. The present invention is also directed to the combination of such a ribbon cassette with such a machine.

12 Claims, 1 Drawing Sheet

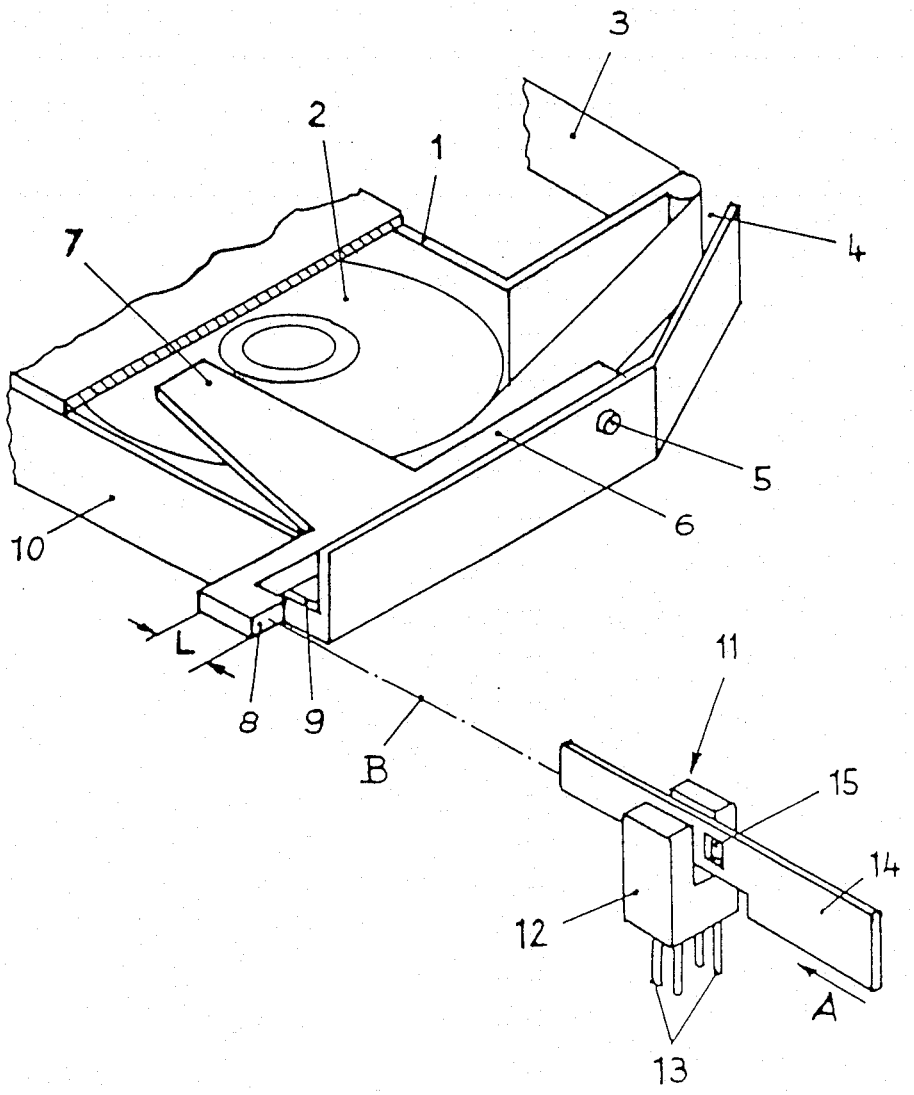
3
2
1
7
4
5
6
10
L
8
9
B
11
15
14
12
A
13

RIBBON CASSETTE

BACKGROUND OF THE INVENTION

The subject of the invention is a ribbon cassette for electronically controlled typewriters or similar machines equipped with a signal generator, the ribbon cassette being disposed on a carriage movable along the platen. The invention is also directed to the combinatioin of such a ribbon cassette with such a machine. It happens in such machines again and again that it is not recognized at all whether or not a ribbon cassette is inserted. It should be recognizable additionally, without the operator having to continually check, whether the ribbon supply is at an end or whether the transport step for the ribbon was adjusted optimally. If the transport step is not adjusted in accordance with the ribbon type, the result is either poor reproductions or the use of unnecessarily large amounts of ribbon.

In DE-GM No. 79 10 078 a device is described which recognizes when the ribbon is used up. However, this known machine requires that the type carrier carriage also pull a Bowden wire. Adjusting to different transport steps is not known from this publication.

It is known from DE-G No. 81 13 008 to select automatically one of two ribbon transport steps by means of a design feature on the ribbon cassette. This is done purely mechanically. The end of the ribbon is not detected. Also, DE-OS No. 31 09 299 is a known device by means of which an automatic adjustment of the transport step takes place. But this known device has the disadvantage that position tolerances can have an unfavorable effect, for instance, between ribbon cassette and carriage. In addition, the carriage has to move a greater mass. Also, electrical connections must be provided from this movable device to the stationary machine logic, which requires additional electrical lines. This device is also not suited to detect the ribbon end.

It would cause additional costs if it were intended to realize in these devices a transport step adjustment or a ribbon end detector.

SUMMARY OF THE INVENTION

It is an object of the invention to create a simple device making it possible both to signal whether a ribbon cassette is inserted at all and to adjust the transport step automatically if required. This is provided by the ribbon cassette according to the present invention, without loading the carriage with an additional mass. An advantage is that the expense of the ribbon cassette is not increased. There is also no additional loading of the carriage with switches, light barriers or cables.

By means of the ribbon cassette according to the present invention, a signal is provided to indicate whether or not a ribbon cassette has been inserted. Further the machine can be adjusted automatically to the transport step appropriate for the type of ribbon. Also, a warning signal is emitted when the ribbon is used up, or the machine can be automatically shut off.

Overall, greatly different operating states of a typewriter or printer can be detected or set with the present invention, without the operator having to pay special attention to the ribbon. The interpretable information, resulting from the interaction of the switching element on the cassette with the signal generator provided on the machine according to the present invention, can be obtained, for example, during the usual operation of turning-on such machines. Signaling the end of the ribbon, or the shutting off of the machine when the ribbon end is reached, makes it necessary for the switching element to interact with the signal generator in certain time intervals during the operation of the machine. This can be done, for instance, when the carriage reaches the left margin. But it is also possible by actuating a certain key, e.g. the backspacer, to run an intermediate routine during which the signal generator is activated.

BRIEF DESCRIPTION OF THE DRAWING

The drawing indicates schematically one exemplary embodiment of the invention, showing a part of a ribbon cassette and the signal generator provided on the machine side.

DESCRIPTION OF PREFERRED EMBODIMENTS

The ribbion cassette 1 comprises a coil 2 of ribbon 3 on a supply spool, from which the ribbon 3 is unwound and led to the outside through an opening 4. Not shown in the drawing are the inlet opening and the rewind spool. A lever 6, a tab 7 of which rests on the coil 2 on the supply spool, is mounted so as to pivot about an axis 5. In the embodiment shown, an extension of the lever 6 with a switching element 8 projects through a cutout 9 in a wall 10 of the ribbon cassette 1 to the outside.

Installed in the typewriter itself is a signal generator 11. The embodiment shown includes a forked light barrier 12 and a slide 14 which is spring-loaded in the direction of arrow A. In the slide 14 are windows 15 which alternately let the light beam of the forked light barrier 12 go through or interrupt it.

The signal generator 11 is mounted in relation to the switching element 8 in the ribbon cassette so that the switching element 8 activates the signal generator 11 in certain time intervals during the operation of the machine. For example, the signal generator 11 may be disposed on the left side of the machine frame so as to be activated whenever the carriage arrives in its position at the beginning of the line. But it is also possible by actuating a certain key, e.g. the backspacer, to activate an intermediate routine in which the signal generator 11 is acted upon by the switching element 8.

Through the interaction of switching element 8 and signal generator 11, information important for the operation of the machine can be imparted to the machine. For example, if no ribbon cassette 1 is present, the signal generator 11 is not activated. Thus, the machine logic does not permit operation of the machine. The same occurs if the tab 7 of lever 6 slides off the coil 2 on the supply spool, as a result of the diameter of the coil 2 becoming too small to support the tab 7. The switching element 8 then assumes a position below the line B, which also results in the slide 14 of the signal generator 11 being unable to be acted upon when the carriage with the ribbon cassette 1 reaches a certain position, namely a position at which a signal pulse would normally be generated. Therefore, if the diameter of the coil 2 on the supply spool decreases during operation of the machine to the point that the tab 7 of lever 6 can drop, this results in production of a signal "ribbon used up, insert new ribbon cassette". The tab, however, may be designed so that the ribbon supply remaining at that time still suffices to print a predetermined number of characters.

As to its length L, the switching element 8 may be differently designed, depending on the type of ribbon 3 installed in the ribbon cassetee 1. If L is short, the slide 14 is moved a short distance only so that only one status change is generated, for example from BRIGHT to DARK. This signal can be utilized to set the transport step for the ribbon 3 to a clearly defined length. If L is longer, the slide 14 is moved a greater distance so that several status changes can be generated, for instance by the slide 14 containing several windows 15. This signal sequence then sets a predetermined other transport step for the ribbon 3 by means of the machine logic. Of course, several different ribbon types can thus be recognized, and the transport steps set accordingly.

A modification of the embodiment shown can involve replacing the forked light barrier 12 of the signal generator 11 by a different device. In cases in which it is not necessary to also signal the end of the ribbon 3 coiled on the supply spool, the switching element can also be mounted as a stationary element on the ribbon cassette to indicate the type of ribbon to control the transport step.

Thus, the advantages described above can be obtained at minimal cost. In particular, the extra costs for the ribbon cassette 1 are negligible, because the lever 6 with the tab 7 and the switching element 8 can be designed as simple injection-molded parts, which can also be assembled automatically on the ribbin cassette 1.

It will be obvious to those skilled in the art that various changes may be made without departing from the scope of the invention. Accordingly, the invention is not to be considered limited to what is shown in the drawings and described in the specification.

What is claimed is:

1. A ribbon cassette for electronically controlled machines having a signal generator fixed thereto and a moveable carriage, the ribbon cassette being disposed on said carriage and including a supply spool, a coil of ribbon disposed on said supply spool, and a switching element, wherein said signal generator is actuable by means of said switching element when the carriage is in a predetermined position such that said switching element comes into contact with said signal generator and said switching element has a different length depending on the type of ribbon in the cassette, and said signal generator is selectably actuable by said switching element to output a first signal indicating that more than a predetermined amount of the ribbon remains on said supply spool and to output a second signal corresponding to the type of ribbon when said carriage is in said predetermined position.

2. The ribbon cassette of claim 1, wherein said signal generator outputs a second signal corresponding to the type of ribbon when said carriage is in said predetermined position.

3. The ribbon cassette of claim 1, wherein the switching element is disposed as a projection on a lever which is pivotable from a first into a second end position as a function of the diameter of coil remaining in the supply spool, and the signal generator is activatable by means of the switching element in only a respective one of these end positions.

4. In an electronically controlled device for printing with a ribbon, having a fixed portion and a moveable carriage, and a cassette with a coil of said ribbon disposed on said carriage, the improvement wherein said cassette includes a switching element contacting said coil of ribbon to indicate when an amount of said ribbon remaining in said coil for the printing decreases below a predetermined amount, said switching element having a different length depending on the type of said ribbon in the cassette, and a signal generator is fixed on said fixed portion and is conditionally operatively connected with said switching element during at least one predefined operation of said printing device, for providing a first signal corresponding to a first condition of whether or not said remaining amount of ribbon is less than said predetermined amount and a second signal corresponding to the type of ribbon in the cassette for setting a respective transport step to be provided by said machine for the printing.

5. The device of claim 4, wherein said signal generator is operatively connected to said switching element during each said predefined operations only when said amount of remaining ribbon is more than said predetermined amount.

6. The device of claim 4, wherein the conditional operative connection of said switching element of said respective shape with said signal generator during each said predefined operation is such that said signal generator conditionally outputs a signal corresponding to said type of ribbon each time each said predefined operation occurs, for setting a respective transport step to be provided by said machine for said printing.

7. The device of claim 4, wherein if said cassette is omitted to be disposed on said carriage constituting failure of a second condition for said conditional operative connection, said signal generator provides a corresponding signal during the first occurrence of said predefined operation, as a result of absence of the operative connection of said signal generator with said switching element.

8. The device of claim 7, wherein said signal generator outputs the same signal when said cassette is not disposed on said carriage as when the remaining amount of said ribbon is less than said predetermined amount.

9. The device of claim 7, wherein said switching element has a respective shape corresponding to each of a plurality of possible types of said ribbon, and the operative connection of said switching element with said signal generator is such that said signal generator outputs a respective signal during each said operative connection to control a transport step for said ribbon depending on its type.

10. The device of claim 4, wherein said switching element comprises a lever rotating about an axis in said cassette and having a tab resting on a part of said coil, and having a contact end portion which lowers when said part of said coil of said ribbon is unwound, and said signal generator comprises a light generator and detector means, and a slide contacted by said contact end portion of said lever of said switching element, wherein a relative position of said slide with respect to said light generating and detecting means, depending on an amount of light detected due to position of said slide, operates to provide said signal indicating whether the amount of remaining tape is more or less than said predetermined amount.

11. The device of claim 10, said slide comprising at least one window, said ribbon being one of a plurality of types, and said contact end portion having a respective geometry corresponding to said type of ribbon for controlling a transport step depending on the number of said windows detected by said light generator and detector means as a result of the contact of said contact end portion of the lever with said slide.

12. The ribbon cassette of claim 1, wherein said switching element comprises a lever rotating about an axis in said cassette and having a tab resting on a part of said coil, and having a contact end portion which lowers when said part of said coil of said ribbon in unwound, and said signal generator comprises a light generator and detector means, and a slide contacted by said contact end portion of said lever of said switching element.

* * * * *